US007891896B2

(12) United States Patent
Nasu

(10) Patent No.: US 7,891,896 B2
(45) Date of Patent: Feb. 22, 2011

(54) STICK COSMETIC ADVANCING CONTAINER

(75) Inventor: Mieko Nasu, Yokohama (JP)

(73) Assignee: Shiseido Company, Ltd., Tokyo (JP)

( * ) Notice: Subject to any disclaimer, the term of this patent is extended or adjusted under 35 U.S.C. 154(b) by 335 days.

(21) Appl. No.: 11/667,832

(22) PCT Filed: Dec. 9, 2005

(86) PCT No.: PCT/JP2005/022665

§ 371 (c)(1),
(2), (4) Date: May 16, 2007

(87) PCT Pub. No.: WO2006/062192

PCT Pub. Date: Jun. 15, 2006

(65) Prior Publication Data

US 2008/0050169 A1 Feb. 28, 2008

(30) Foreign Application Priority Data

Dec. 9, 2004 (JP) ..... 2004-357020

(51) Int. Cl.
*A45D 40/04* (2006.01)

(52) U.S. Cl. ..... 401/68; 401/65; 401/9

(58) Field of Classification Search ..... 401/55, 401/65, 66, 68, 173, 9
See application file for complete search history.

(56) References Cited

U.S. PATENT DOCUMENTS 2,457,342 A * 12/1948 Braselton ..... 401/11
3,219,044 A 11/1965 Bau
5,018,892 A * 5/1991 Krueckel et al. ..... 401/68
5,085,352 A * 2/1992 Sasaki et al. ..... 222/327
5,813,421 A 9/1998 Wang

FOREIGN PATENT DOCUMENTS

| | | |
|---|---|---|
| DE | 3835679 | 4/1990 |
| FR | 728208 | 7/1932 |
| JP | 2-142674 | 12/1990 |
| JP | 2002-355118 | 12/2002 |
| JP | 2004-201907 | 7/2004 |

OTHER PUBLICATIONS

Extended European search report dated Nov. 5, 2010.

* cited by examiner

*Primary Examiner*—David J Walczak
(74) *Attorney, Agent, or Firm*—IPUSA, PLLC

(57) ABSTRACT

A stick cosmetic advancing container has a stick type cosmetic, an interior plate, a tubular sleeve having an application opening at its tip portion from which the stick type cosmetic is advanced, and a moving mechanism for moving the interior plate within the sleeve. A user holds the stick cosmetic advancing container to apply the stick type cosmetic. The sleeve is arranged to have a uniform internal cross-sectional shape throughout the moving range of the stick type cosmetic. Further, the surface of the application opening is inclined at an angle of θ1 with respect to the central axis A of the sleeve. Also, an outer side wall thickness W1 of an outer side wall portion 18 is arranged to be less than an inner side wall thickness W2 of an inner side wall portion 19.

5 Claims, 7 Drawing Sheets

STICK COSMETIC ADVANCING CONTAINER

TECHNICAL FIELD

The present invention relates to a stick cosmetic advancing container that is used to enable a stick type cosmetic such as lipstick to advance from a sleeve.

BACKGROUND ART

Generally, a stick cosmetic advancing container is used as a container for accommodating a stick type cosmetic such as lipstick. Such a stick cosmetic advancing container mainly includes a interior plate on which the stick type cosmetic is mounted, a sleeve that movably accommodates the interior plate in its interior and has an opening at its tip portion from which the stick type cosmetic may advance, and a moving mechanism that raises and lowers the interior plate with respect to the sleeve to move the stick type cosmetic forward or backward (e.g., see Japanese Laid-Open Patent Publication No. 2004-201907).

A stick type cosmetic with a relatively large diameter is used in a conventional stick cosmetic advancing container, and the stick type cosmetic with the large diameter is arranged to advance at a relatively long length from the sleeve opening upon being applied to an application portion (e.g., lips). However, the outlines of the application portion may not be accurately drawn in the case of using the stick type cosmetic with a large diameter, for example, and since the stick type cosmetic has to advance relatively far, it may be prone to breaking. Further, upon continued use of the stick type cosmetic with the large diameter, the tip portion may become round to thereby make it difficult to accurately draw outlines of the application portion.

Japanese Laid-Open Patent Publication No. 2002-355118 discloses a stick cosmetic advancing container that has been developed in view of the above-described problems. The disclosed stick cosmetic advancing container has a sleeve with a smaller internal diameter compared to that of the stick cosmetic advancing container disclosed in Japanese Laid-Open Patent Publication No. 2004-201907 so that the diameter of the stick type cosmetic accommodated therein may also be reduced to thereby enable accurate depiction of the outlines of the application portion.

It is noted that there is a growing trend toward using a stick type cosmetic that is softer than the conventional stick type cosmetic having desirable characteristics for achieving adequate usability. Such a soft stick type cosmetic, when used in a stick cosmetic advancing container as is disclosed in Japanese Laid-Open Patent Publication No. 2002-355118 that includes an ogive with a small diameter, may be prone to deformation and breaking. As can be appreciated, when a soft stick type cosmetic is used in a conventional stick cosmetic container, usability of the stick type cosmetic may be degraded and accurate depiction of the outlines of the application portion may not be possible.

DISCLOSURE OF THE INVENTION

Embodiments of the present invention are generally directed to an improved stick cosmetic container that overcomes one or more of the above-described problems of the related art.

More specifically, embodiments of the present invention are directed to a stick cosmetic container accommodating a stick type cosmetic that is adapted to improve usability and prevent a soft stick type cosmetic from breaking.

According to one embodiment of the present invention, a stick cosmetic advancing container that is held by a user upon being used is provided that includes:

a stick type cosmetic;

an interior plate that holds the stick type cosmetic;

a tubular sleeve that accommodates the interior plate and enables the interior plate to move in an advancing direction of the stick type cosmetic, the tubular sleeve having a tip portion at which an application opening is formed for applying the stick type cosmetic that is advanced in the advancing direction; and a moving mechanism that moves the interior plate within the sleeve; wherein an internal cross-sectional shape of the sleeve is arranged to be uniform throughout a moving range of the stick type cosmetic within the sleeve;

an opening surface of the application opening is inclined with respect to a central axis of the sleeve; and an outer side wall thickness of an outer side wall portion of the sleeve that is to be positioned outward with respect to the user is arranged to be less than an inner side wall thickness of an inner side wall portion of the sleeve that is to be positioned toward the user.

In one aspect of the present invention, since the opening surface of the application opening is inclined with respect to the central axis of the sleeve, the user may not have to bend her arm to such a great extent upon holding the stick cosmetic container to apply the stick type cosmetic so that usability of the stick cosmetic container may be improved.

In another aspect of the present invention, by changing the wall thickness of the application opening of the sleeve rather than realizing a uniform wall thickness; namely, by arranging the outer side wall thickness (thickness of the portion of the sleeve positioned outward with respect to the user) to be less than the inner side wall thickness (thickness of the portion of the sleeve positioned toward the user), the outer edge of the sleeve and the outer edge of the stick type cosmetic may be at substantially the same position at the outer side of the sleeve so that outlines of a desired application portion in particular may be accurately drawn.

In another aspect of the present invention, since the sleeve itself is configured to enable desirable outline depiction of the desired application portion, only a slight amount of the stick type cosmetic may need to be advanced from the application opening upon applying the stick type cosmetic. Accordingly, the stick type cosmetic may not have to be advanced at great length so that it may be prevented from breaking.

In another aspect of the present invention, by arranging the internal cross-sectional shape of the sleeve to be uniform throughout the moving range of the stick type cosmetic, stress applied to the stick type cosmetic when it moves in the advancing direction within the sleeve may be reduced and the stick type cosmetic may be prevented from breaking.

According to a preferred embodiment of the present invention, the moving mechanism may be configured to generate a clicking motion that moves the stick type cosmetic by a predetermined advancing amount corresponding to an amount to be applied in one application procedure.

In one aspect of the present embodiment, since one clicking motion causes the stick type cosmetic to move by an advancing amount corresponding to an amount to be applied in one application procedure, the stick type cosmetic may be prevented from excessively advancing so that it may be prevented from breaking and be applied under suitable conditions.

According to another preferred embodiment of the present invention, the moving mechanism may be a ratchet mechanism.

In one aspect of the present embodiment, by arranging the moving mechanism into a ratchet mechanism, the stick type cosmetic that is advanced forward may be prevented from retracting. In this way, the stick type cosmetic may be protected from stress that may be applied thereto as a result of retracting so that it may be prevented from breaking.

According to another preferred embodiment of the present invention, the inclination angle of the opening surface with respect to the central axis may be within a range of 45-85 degrees.

In one aspect of the present embodiment, by arranging the inclination angle of the opening surface with respect to the central axis to be within a range of 45-85 degrees, usability of the stick cosmetic advancing container for applying the stick type cosmetic may be improved.

Specifically, when the inclination angle of the opening surface with respect to the central axis is less than 45 degrees, the stick cosmetic advancing container may have to be held rather upright upon being used for applying the stick type cosmetic so that usability of the advancing container may be degraded. When this inclination angle is greater than 85 degrees, the advancing container may have to be held at a substantially horizontal position to thereby create inconveniences with regard to usability.

According to another preferred embodiment of the present invention, an angle formed by an outer face of the outer side wall portion of the sleeve and the opening surface may be within a range of 45-65 degrees.

In one aspect of the present embodiment, by arranging the angle formed by the outer face of the outer side wall portion and the opening surface to be within a range of 45-65 degrees, usability of the advancing container may be improved for applying the stick type cosmetic.

Specifically, in the case where the angle formed by the outer face of the sleeve and the opening surface is greater than 65 degrees, a user of the advancing container may have trouble viewing the outer edge of the application portion upon applying the stick type cosmetic using a mirror and may experience difficulties in accurately drawing the outlines of the application portion. In the case where the angle formed by the outer face of the sleeve and the opening surface is less than 45 degrees, the advancing container may be too narrow for practical use.

According to another preferred embodiment of the present invention, the outer side wall thickness may be within a range of 0.2-0.8 mm.

In one aspect of the present embodiment, by arranging the outer side wall thickness to be within a range of 0.2-0.8 mm, outlines of the application portion (e.g., lips) may be accurately drawn upon applying the stick type cosmetic. Specifically, in the case where the outer side wall thickness is less than 0.2 mm, it may be difficult to form the application opening at the sleeve, and in the case where the outer side wall thickness is greater than 0.8 mm, it may be difficult to accurately draw the outlines of the application portion.

As can be appreciated from the above descriptions, embodiments of the present invention may enable accurate depiction of the outlines of a desired application portion, prevent the stick type cosmetic from breaking, and improve usability of the stick cosmetic advancing container, for example.

BEST MODE FOR CARRYING OUT THE INVENTION

In the following, preferred embodiments of the present invention are described with reference to the accompanying drawings.

Figure 1:
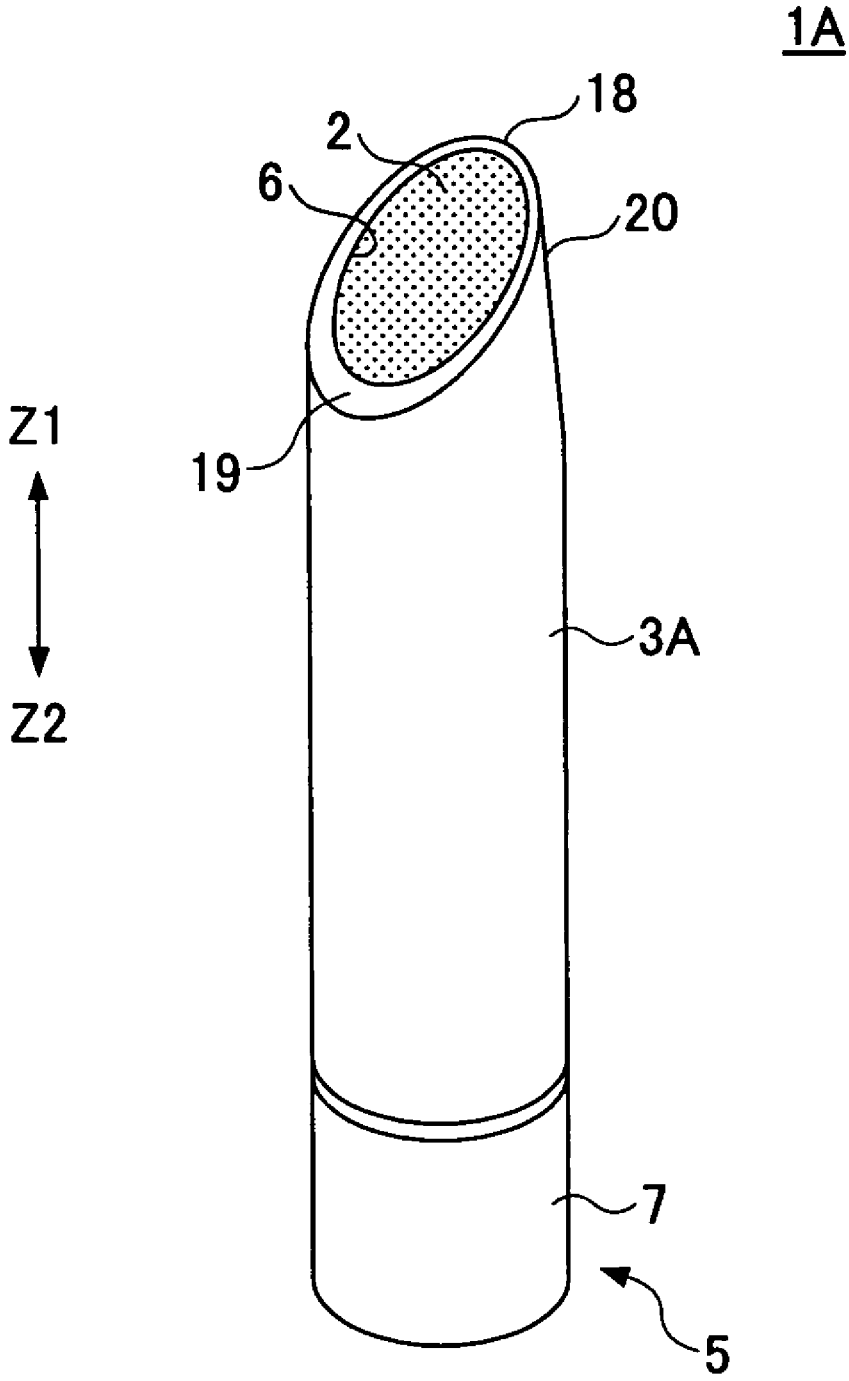
FIG. 1 is a perspective view of a stick cosmetic advancing container according to an embodiment of the present invention.
Figure 2:
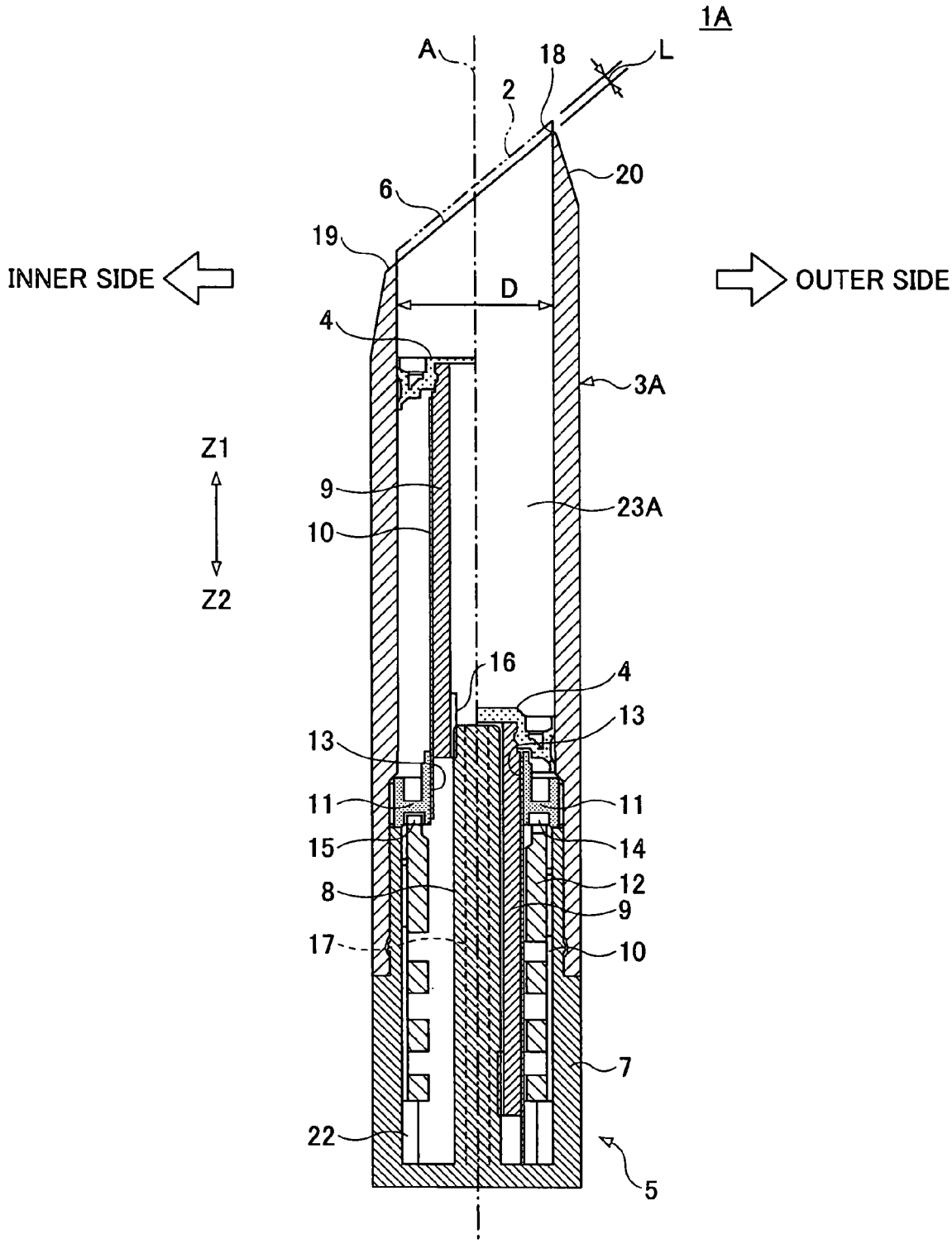
FIG. 2 is a cross-sectional view of the stick cosmetic advancing container according to the present embodiment.
Figure 3A:
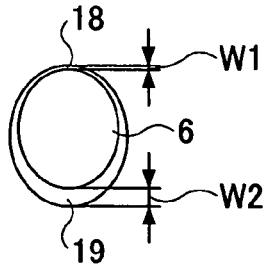
FIG. 3A is a diagram showing a configuration of an application opening of the stick cosmetic advancing container according to the present embodiment viewed from the direction of arrow A shown in FIG. 3B.
Figure 3B:
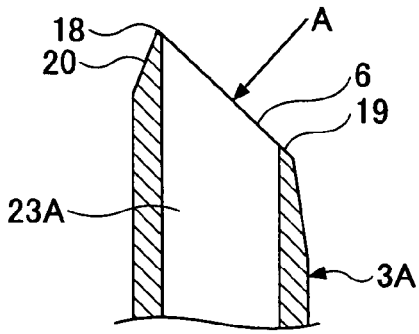
FIG. 3B is a vertical cross-sectional view of a sleeve portion in the vicinity of the application opening.
Figure 3C:
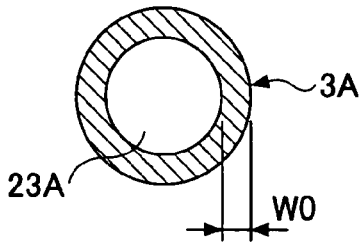
FIG. 3C is a horizontal cross-sectional view of the sleeve portion in the vicinity of the application opening.

FIGS. 1 and 2 are diagrams illustrating a stick cosmetic advancing container 1A (simply referred to as "advancing container" hereinafter) according to an embodiment of the present invention. Specifically, FIG. 1 is an external perspective view of the advancing container 1A, and FIG. 2 is a cross-sectional view of the advancing container 1A. It is noted that in FIG. 2, the illustrated advancing container 1A is divided by a center line A where the right side portion shows a stick type cosmetic 2 that has not yet advanced forward (before usage) and the left side portion shows the stick type cosmetic 2 that has advanced to the end (usage end).

The illustrated advancing container 1A is held by a user upon being used, and has the function of enabling the stick type cosmetic 2 to advance forward (i.e., to move in the direction of arrow Z1 in FIGS. 1 and 2). In the following, an example in which lipstick is used as the stick type cosmetic 2 is described. Also, it is assumed that in the illustrated example, the stick type cosmetic 2 is made of soft material rather than material with desirable characteristics for improving usability. It is noted that the stick cosmetic advancing container 1A is not limited to being used for accommodating lipstick and may equally be used as a container for accommodating other types of stick type cosmetics such as eye shadow.

The advancing container 1A mainly includes a sleeve 3A (outer tube), an interior plate 4, and a moving mechanism 5. The sleeve 3A may be formed by arranging metal or resin into a cylindrical hollow structure, and the stick type cosmetic may be accommodated within the sleeve 3A. Since the sleeve 3A is arranged into a cylindrical hollow structure, a hollow portion 23A having a circular cross-sectional shape is formed within the sleeve 3A. It is noted that the diameter of the hollow portion 23A (represented by arrow D in FIG. 2) is arranged to be uniform throughout the length (Z1-Z2 directions) of the sleeve 3A.

Also, an application opening 6 is formed at the upper tip portion of the sleeve 3A (Z1 direction tip portion in FIGS. 1 and 2), and the stick type cosmetic 2 is arranged to advance forward from this application opening 6. Also, the application opening 6 is arranged to form a predetermined angle with respect to the central axis (represented by the one-dotted line A in FIG. 2) of the sleeve 3A as is described in detail below.

Upon applying the stick type cosmetic 2, a user may hold the stick cosmetic advancing container 1A at a certain angle so that the application opening 6 (the stick type cosmetic 2 coming out of the application opening 6) may face the lips (application portion) of the user. Specifically, the stick cosmetic advancing container 1A may be held so that the left side of the sleeve 3A in FIG. 2 (referred to as "inner side" hereinafter) is positioned toward the user, and the right side of the sleeve 3A in FIG. 2 (referred to as "outer side") is positioned outward with respect to the user. It is noted that the outer side of the sleeve 3A has an outer side inclined surface 20 that is inclined at a predetermined angle with respect to the application opening 6 (see FIG. 4).

The interior plate 4 holds the stick type cosmetic 2. The periphery of the interior plate 4 comes into sliding contact with the inner wall of the hollow portion 23A so that the interior plate 4 may move in the direction of arrow Z1 within the sleeve 3A. In this way, the stick type cosmetic 2 that is held by the interior plate 4 also moves in the direction of arrow Z1 together with the interior plate 4 to thereby advance from the application opening 6. The interior plate 4 is moved by the moving mechanism 5. Since the sleeve 3A is arranged to have a uniform internal cross-sectional shape throughout the moving range of the stick cosmetic 2 as is described above, stress applied to the stick type cosmetic 2 may be reduced when the stick type cosmetic 2 is moved within the sleeve 3A so that the stick type cosmetic 2 may be prevented from breaking.

The moving mechanism 5 includes a maneuvering unit 7, a rod 9, a ratchet mechanism 12, and a screw 11. The maneuvering unit 7 is a rotating unit arranged at the bottom tip portion (Z2 direction side tip portion) of the sleeve 3A. The maneuvering unit 7 has a shaft 8 integrally formed at its center that is coaxial with the central axis A. The shaft 8 has plural radial engaging grooves 17 formed thereon.

The rod 9 may be a hollow tube into which the shaft 8 may be inserted. In this arrangement, the rod 9 may move in Z1 and Z2 directions with respect to the shaft 8. Also, the interior plate 4 is rotatably mounted on the upper tip portion of the rod 9, and first engaging ribs 16 are formed at the bottom edge inner wall of the rod 9. Further, a male screw portion 10 is formed around the periphery of the rod 9.

The first engaging ribs 16 of the rod 9 engage the engaging grooves 17 of the shaft 8 so that the rod 9 may slide with respect to the shaft 8. In this way, the rod 9 is arranged to move in Z1 and Z2 directions with respect to the shaft 8 and rotate together with the maneuvering unit 7 via the shaft 8 when the maneuvering unit 7 is rotated.

The ratchet mechanism 12 is arranged at the inner side of the maneuvering unit 7, and a screw 11 is arranged at the upper portion of the ratchet mechanism 12. The ratchet mechanism 12 is arranged into a coil spring configuration and plural ratchet pieces 15 are arranged at its tip portion (Z1 direction tip portion).

The periphery of the screw 11 is fixed to the inner wall of the sleeve 3A, and the inner wall portion of the screw 11 is arranged into a female screw portion 13 that is screwed together with the male screw portion 10 of the rod 9. Also, plural ratchet grooves 14 are formed on the surface of the screw 11 that faces the ratchet pieces 15.

The ratchet pieces 15 are pushed into the ratchet grooves 14 by the elastic force of the ratchet mechanism 12. In the present embodiment, the ratchet grooves 14 are arranged to allow the ratchet pieces 15 to rotate in only one direction (referred to as "correct rotation" hereinafter) and restrict rotation in the reverse direction.

Also, the bottom edge portion of the ratchet mechanism 12 engages second engaging ribs 22 that are formed at the maneuvering unit 7. In this way, the ratchet mechanism 12 may rotate together with the maneuvering unit 7 when the maneuvering unit 7 is rotated.

By arranging the moving mechanism 5 to have the above-described configuration, the ratchet mechanism 12 may rotate together with the maneuvering unit 7 when the maneuvering unit 7 is rotated in the correct rotation direction, and the ratchet pieces 15 formed on the Z1 side tip portion of the ratchet mechanism 12 may run over the ratchet grooves 14 formed on the female screw portion 13 as a result of which the user may feel a clicking motion. Thus, the user may feel the maneuvering unit 7 clicking upon rotating the maneuvering unit 7.

Upon rotating the maneuvering unit 7 in the correct rotation direction, the shaft 8 also rotates together with the maneuvering unit 7, and in turn, the rod 9 also rotates in the correct rotation direction. As is described above, the female screw portion 13 of the screw 11 that is fixed to the sleeve 3A is screwed together with the male screw portion 10 of the rod 9. Thus, when the rod 9 rotates in the correct rotation direction, it moves in the Z1 direction with respect to the screw 11.

In turn, the stick type cosmetic 2 held by the interior plate 4 that is mounted on the rod 9 is also moved in the Z1 direction. In this way, the stick type cosmetic 2 is advanced from the application opening 6 of the sleeve 3A. Since the interior plate 4 is rotatbly mounted on the rod 9 and the periphery of the interior plate 4 is in sliding contact with the inner wall of the sleeve 3A, the interior plate 4 may not rotate even when the rod 9 is rotated so that the stick type cosmetic 2 held by the interior plate 4 may also advance without rotating.

The pitch of the ratchet grooves 14 and the ratchet pieces 15 and the pitch of the screw portions 11 and 13 are arranged so that the stick type cosmetic 2 may advance from the application opening 6 by an optimal advancing amount (represented by distance L in FIG. 2) through rotation of the maneuvering unit 7 by a predetermined rotation amount for achieving one clicking motion, namely, for having each of the ratchets 15 run over one ratchet groove 14. Such an arrangement prevents the stick type cosmetic 2 from excessively advancing out of the application opening 6 to thereby protect the stick type cosmetic 2 from breaking even when the stick type cosmetic 2 is made of soft material. Also, this arrangement enables application of the stick type cosmetic 2 on the lips under desirable conditions.

According to the present embodiment, the ratchet mechanism 12 is used as the moving mechanism 5 so that the stick type cosmetic 2 may be prevented from being retracted into the sleeve 3A once it advances therefrom. In this way, the stick type cosmetic 3 may be prevented from receiving stress that may be applied thereto when it is retracted into the sleeve 3A so that it may be prevented from breaking. It is noted that the moving mechanism 5 does not necessarily have to use the ratchet mechanism 12, and other types of advancing mechanisms for moving the stick type cosmetic forward by a predetermined amount may be used as well.

In the following, a configuration of the application opening 6 is described. First, the thickness of the side wall defining the application opening 6 is described. As is shown in FIGS. 1, 2, and FIGS. 3A-3C, the application opening 6 is arranged such that the outer side wall thickness W1 (see FIG. 3A) of an outer side wall portion 18 is arranged to be less than the inner side wall thickness W2 (see FIG. 3A) of an inner side wall portion 19 (W1<W2). Also, a gradual change in thickness is realized from the outer side wall portion 18 to the inner side wall portion 19 so that the wall defining the application opening 6 does not include a portion with an abrupt change in shape (such as a stepped portion).

At the outer side wall portion 18 (i.e., portion of the sleeve 3A positioned outward with respect to the user holding the advancing container 1A), the outer edge of the sleeve 3A and the outer edge of the stick type cosmetic 2 may be disposed at substantially the same position; in other words, as is the case with a conventional stick type cosmetic, only the outer edge of the stick type cosmetic 2 may actually come into contact with the lips of the user upon applying the stick type cosmetic 2. Accordingly, by changing the wall thickness of the application opening 6 of the sleeve 3A as opposed to realizing a uniform wall thickness; namely, by arranging the thickness W1 of the outer side wall portion 18 to be less than the thickness W2 of the inner side wall portion 19, the outlines of a desired application portion may be accurately drawn, for example.

Also, since the sleeve 3A itself is configured to enable accurate outline depiction of a desired application portion, only a slight amount of the stick type cosmetic 2 may need to be advanced upon applying the stick type cosmetic 2. In other words, the stick type cosmetic 2 does not have to be advanced from the sleeve 3A at great length so that the stick type cosmetic 2 may be prevented from breaking.

In a specific example, the outer side wall width W1 of the outer side wall portion 18 may be arranged to be within a range of 0.2-0.8 mm (0.2 mm≦W1≦0.8 mm). It is noted that when the outer side wall thickness W1 is less than 0.2 mm, it may be difficult to form the application opening 6 at the sleeve 3A, and if the outer side wall width W1 is greater than 0.8 mm, it may be difficult to accurately draw the outlines of the desired application portion upon applying the stick type cosmetic 2.

Also, it is noted that a so-called chamfering process may be performed on the outer side wall portion 18, and the curvature radius of the resulting chamfer may preferably be within a range of 0.3-3 mm. By arranging the cross-sectional shape of the outer side wall portion 18 into a curved shape having a predetermined curvature radius, a user may be prevented from feeling discomfort when the outer side wall portion 18 comes into contact with the lips of the user even though the outer side wall width W1 of the outer side wall portion 18 is arranged to be relatively thin at 0.2-0.8 mm.

Figure 4:
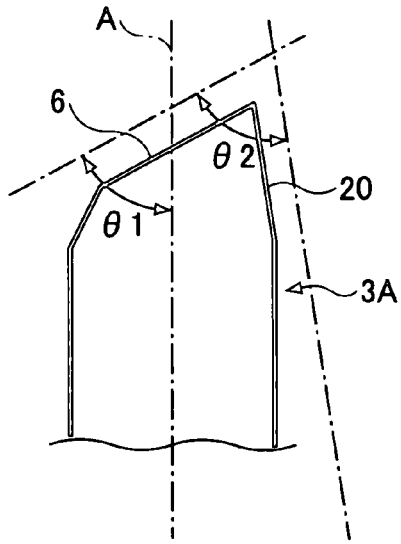
FIG. 4 is a diagram showing inclination angles of the application opening of the stick cosmetic advancing container according to the present embodiment.

Next, the slope of the application opening 6 is described with reference to FIGS. 1, 2, and 4. In the present embodiment, the surface of the application opening 6 (opening surface) is arranged to incline at a predetermined angle (represented by θ1 in FIG. 4) with respect to the central axis A of the sleeve 3A and is also arranged to incline at a predetermined angle (represented by θ2 in FIG. 4) with respect to the outer side inclined surface 20.

In one specific example, the inclination angle θ1 of the opening surface with respect to the central axis A of the sleeve 3A may be within a range of 45-85 degrees (45°≦θ1≦85°). By arranging the opening surface to be inclined at a predetermined angle range with respect to the central axis A of the sleeve 3A as is described above, usability of the stick cosmetic advancing container 1A may be improved, for example.

It is noted that when the inclination angle θ1 of the opening surface with respect to the central axis A is less than 45 degrees, the stick cosmetic advancing container 1A may have to be held upright upon applying the stick type cosmetic 2 so that usability of the advancing container 1A may be degraded. Also, when the inclination angle θ1 of the opening surface is greater than 85 degrees, the stick cosmetic container 1A may have to be held at a substantially horizontal position which also creates inconveniences with regard to usability.

Also, the inclination angle θ2 of the opening surface with respect to the outer side inclined surface 20 of the sleeve 3A may be within a range of 45-65 degrees (45°≦θ1≦65°), for example. By arranging the angle θ2 formed by the outer side inclined surface 20 and the surface of the application opening 6 to be within a predetermined angle range as is described above, usability of the stick cosmetic advancing container 1A may be improved.

It is noted that when the inclination angle θ2 is greater than 65 degrees, a user may have trouble viewing the application position of the tip (outer side wall portion 18) of the stick cosmetic container 1A upon applying the stick type cosmetic 2 using a mirror and may have difficulties in accurately drawing outlines of the application portion. Also, in the case of using a mirror, images of the advancing container 1A as well as the hand of the user may be reflected on the mirror and this may also create inconveniences in applying the stick type cosmetic 2. On the other hand, when the inclination angle θ2 formed by the outer side inclined surface 20 and the opening surface is less than 45 degrees, the advancing container 1A may be too narrow for practical use. Accordingly, by setting the inclination angle θ2 of the surface of the application opening 6 within a predetermined angle range as is described above, the stick type cosmetic 2 may be suitably applied using the advancing container 1A.

Figure 5A:
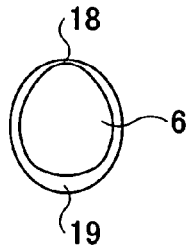
FIG. 5A is a diagram showing a configuration of an application opening of a stick cosmetic advancing container according to a first modified embodiment of the present invention viewed from the direction of arrow A shown in FIG. 5B.
Figure 5B:
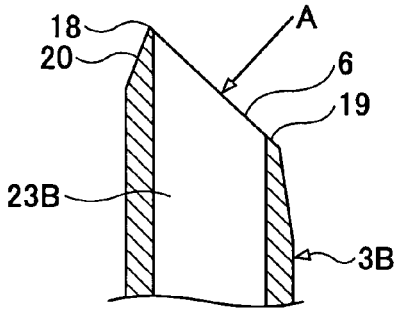
FIG. 5B is a vertical cross-sectional view of a sleeve portion in the vicinity of the application opening.
Figure 5C:
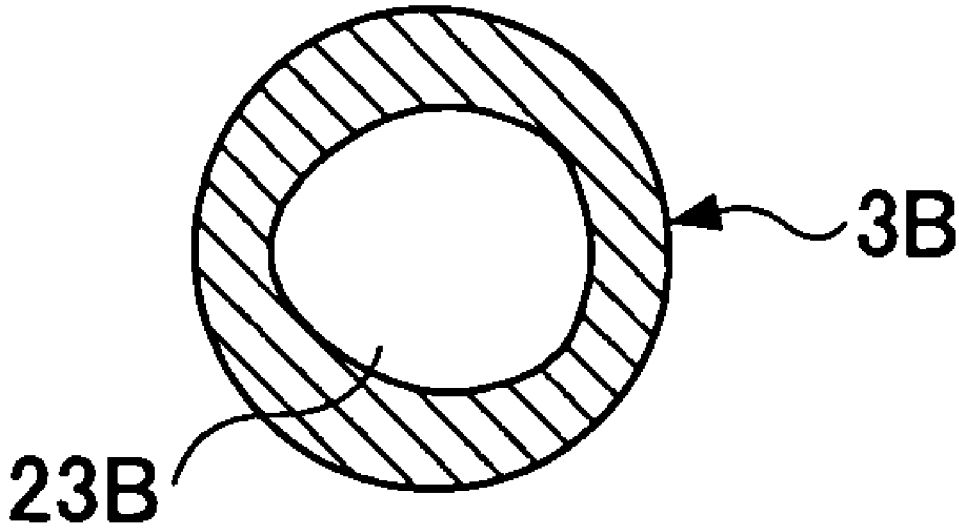
FIG. 5C is a horizontal cross-sectional view of the sleeve portion in the vicinity of the application opening.

It is noted that in the advancing container 1A according to above-described embodiment, the cross-sectional shape of the sleeve 3A is arranged to be circular. However, the present invention is not limited to such an embodiment, and in a first modified embodiment as is illustrated in FIGS. 5A-5C, a sleeve 3B may have an oval cross-sectional shape, for example. In this case, the interior plate 4 of the moving mechanism has to be arranged into a non-rotating member.

Figure 6A:
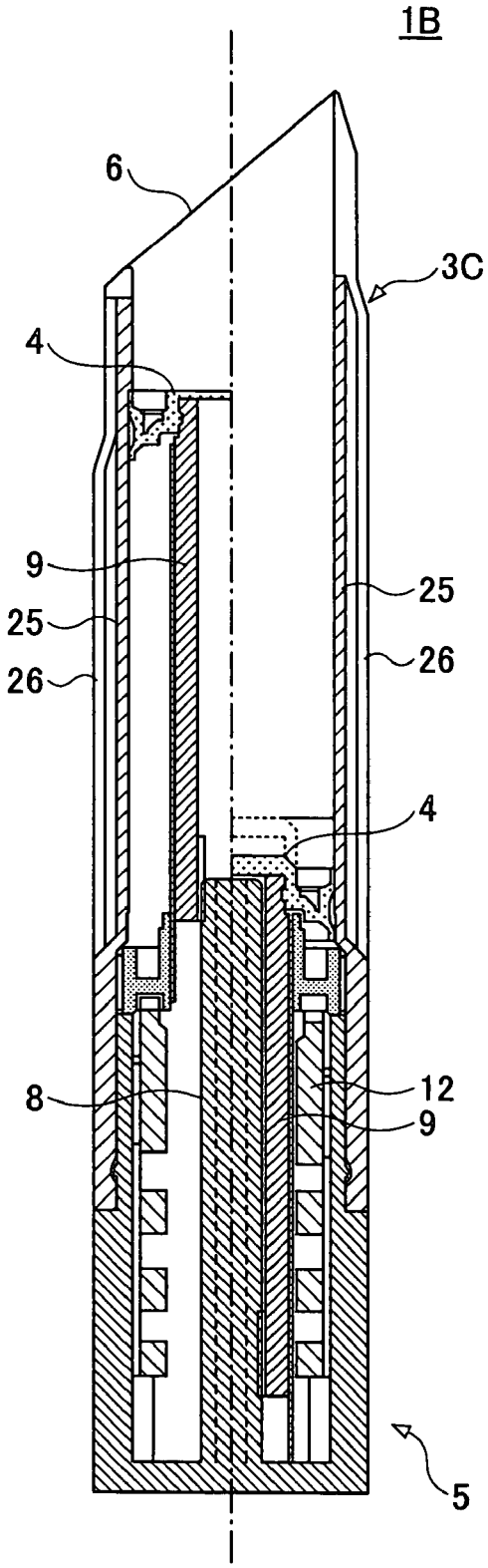
FIG. 6A is a cross-sectional view of a stick cosmetic advancing container according to a second modified embodiment of the present invention.
Figure 6B:
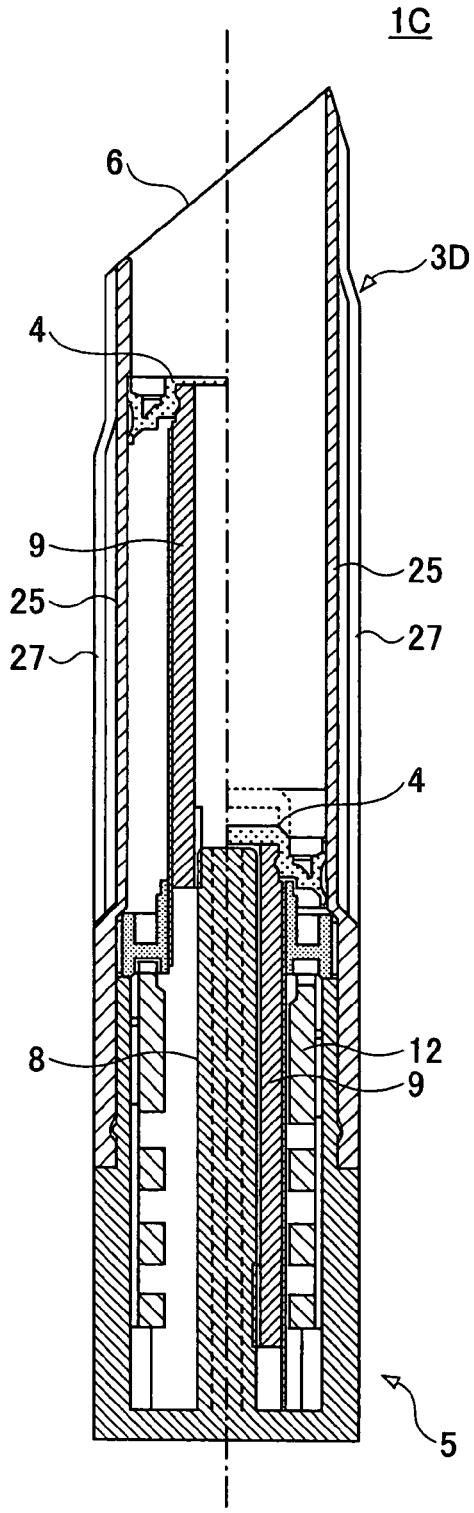
FIG. 6B is a cross-sectional view of a stick cosmetic advancing container according to a third modified embodiment of the present invention.

In the following, other modified embodiments of the advancing container 1A are described. FIGS. 6A and 6B show advancing containers 1B and 1C as second and third modified embodiments of the advancing container 1A. It is noted that in these drawings, components that are identical to those described in relation to FIGS. 1-4 are given the same reference numerals and their descriptions are omitted.

It is noted that the advancing container 1A described above with reference to FIGS. 1-4 is made of metal or resin that is shaped into a cylindrical hollow structure and the sleeve 3A is also made of the same material. In contrast, the advancing containers 1B and 1C of the second and third modified embodiments are characterized in that their respective sleeves 3C and 3D are made of plural types of materials.

The advancing container 1B of the second, modified embodiment shown in FIG. 6A includes a metal inner tube 25 that is covered by a silicon rubber outer tube 26 as the sleeve 3C. It is noted that in this embodiment, the metal inner tube 25 is completely covered by the silicon rubber outer tube 26 so that the application opening 6 (i.e., portion that comes into contact with the lips of the user) is also covered by the silicon rubber opening 26. Such an arrangement may provide more comfort to the user in when the application opening 6 comes into with the lips of the user, for example. The present embodiment may also have the advantages of catering to users having allergies to metal, for example.

The advancing container 1C of the third modified embodiment as is shown in FIG. 6B has a metal inner tube 25 that is covered by a resin outer tube 27 as the sleeve 3D. In the present embodiment, both the metal inner tube 25 and the resin outer tube 27 are exposed at the surface of the application opening 6. By arranging the resin outer tube 27 on the outermost face of the sleeve 3D as in the present embodiment, a variety of design options may be available for fabricating the sleeve 3D since decorative processes may be easily implemented on resin material.

The present application is based on and claims the benefit of the earlier filing date of Japanese Patent Application No. 2004-357020 filed on Dec. 9, 2004, the entire contents of which are hereby incorporated by reference.

The invention claimed is:

1. A stick cosmetic advancing container that is held by a user upon being used, the advancing container comprising:

a stick type cosmetic;

an interior plate that holds the stick type cosmetic;

a tubular sleeve that accommodates the stick type cosmetic and the interior plate, and enables the interior plate to move in an advancing direction of the stick type cosmetic, the tubular sleeve having a tip portion at which an application opening is formed for applying the stick type cosmetic that is advanced in the advancing direction; and a moving mechanism that moves the interior plate within the sleeve; wherein an internal cross-sectional shape of the sleeve is arranged to be uniform throughout a moving range of the stick type cosmetic within said sleeve;

an opening surface of the application opening is inclined with respect to a central axis of the sleeve; and an outer side wall thickness of an outer side wall portion of the sleeve that is to be positioned outward with respect to the user is arranged to be less than an inner side wall thickness of an inner side wall portion of the sleeve that is to be positioned toward the user, and the outer side wall thickness is within a range of 0.2-0.8 mm, the tip portion of the outer side wall portion of the sleeve being chamfered into a curved shape having a curvature radius within a range of 0.3-3.0 mm.

2. The stick cosmetic advancing container as claimed in claim 1, wherein the moving mechanism is configured to generate a clicking motion that moves the stick type cosmetic by a predetermined advancing amount corresponding to an amount to be applied in one application procedure.

3. The stick cosmetic advancing container as claimed in claim 1, wherein the moving mechanism is a ratchet mechanism.

4. The stick cosmetic advancing container as claimed in claim 1, wherein an inclination angle of the opening surface with respect to the central axis is within a range of 45-85 degrees.

5. The stick cosmetic advancing container as claimed in claim 1, wherein an angle formed by an outer face of the outer side wall portion of the sleeve and the opening surface is within a range of 45-65 degrees.

* * * * *